US007062017B1

(12) United States Patent
Runnoe

(10) Patent No.: US 7,062,017 B1
(45) Date of Patent: Jun. 13, 2006

(54) INTEGRAL CATHODE

(75) Inventor: Dennis H. Runnoe, Salt Lake City, UT (US)

(73) Assignee: Varian Medical Syatems, Inc., Palo Alto, CA (US)

( * ) Notice: Subject to any disclaimer, the term of this patent is extended or adjusted under 35 U.S.C. 154(b) by 0 days.

(21) Appl. No.: 09/639,684

(22) Filed: Aug. 15, 2000

(51) Int. Cl.
*H01J 35/06* (2006.01)

(52) U.S. Cl. ..... 378/136

(58) Field of Classification Search ..... 378/121, 378/129, 136, 119; 313/411, 428
See application file for complete search history.

(56) References Cited

U.S. PATENT DOCUMENTS

| | | | | |
|---|---|---|---|---|
| 3,194,625 | A | 7/1965 | Danko | 316/20 |
| 3,558,967 | A * | 1/1971 | Miriam | 313/338 |
| 3,943,393 | A | 3/1976 | Naill | 313/60 |
| 4,065,690 | A | 12/1977 | Maeyama | 313/57 |
| 4,367,556 | A | 1/1983 | Huber et al. | 378/125 |
| 4,573,186 | A * | 2/1986 | Reinhold | 378/138 |
| 4,574,388 | A | 3/1986 | Port et al. | 378/144 |
| 4,670,895 | A | 6/1987 | Penato et al. | 378/125 |
| 4,736,400 | A | 4/1988 | Koller et al. | 378/125 |
| 4,739,214 | A * | 4/1988 | Barr | 313/362.1 |
| 4,788,705 | A * | 11/1988 | Anderson | 378/121 |
| 4,792,687 | A * | 12/1988 | Mobley | 250/423 R |
| 4,825,123 | A | 4/1989 | Franzel et al. | 313/452 |
| 4,995,065 | A | 2/1991 | Janouin et al. | 378/130 |
| 5,056,126 | A | 10/1991 | Klostermann et al. | 378/127 |
| 5,077,777 | A | 12/1991 | Daly | 378/136 |
| 5,264,801 | A * | 11/1993 | DeCou et al. | 378/129 |
| 5,515,413 | A * | 5/1996 | Knudsen et al. | 378/136 |
| 5,623,530 | A | 4/1997 | Lu et al. | 378/136 |
| 5,633,907 | A | 5/1997 | Gravelle et al. | 378/121 |
| 6,066,019 | A * | 5/2000 | Bewlay | 445/28 |
| 6,259,193 | B1 | 7/2001 | Lipkin et al. | 313/341 |

* cited by examiner

*Primary Examiner*—Courtney Thomas
(74) *Attorney, Agent, or Firm*—Workman Nydegger

(57) ABSTRACT

An integral cathode for use with x-ray devices. The integral cathode includes an emitter made of a refractory metal such as tungsten, preferably doped with rhenium to afford malleability during construction and assembly. The integral cathode also includes a support cartridge, preferably composed of an electrically non-conductive material such as ceramic, in which the emitter is received. The support cartridge electrically isolates the cathode from the other components and structures of the x-ray device. Additionally, the support cartridge serves to impose, and maintain, a parabolic curve in the emitter. The parabolic form of the emitter naturally shapes an electron beam by causing electrons discharged from the emitter to converge at a focal spot. In this way, both the emission and focusing functions of the cathode are integrated and performed by a single part.

35 Claims, 4 Drawing Sheets

INTEGRAL CATHODE

BACKGROUND OF THE INVENTION

1. The Field of the Invention

The present invention relates generally to x-ray tubes. More particularly, embodiments of the present invention relate to an x-ray tube cathode that integrates several x-ray tube components into a single unified assembly so as to significantly improve cathode efficiency and electron beam generations, and thereby, the overall performance of the device.

2. The Prior State of the Art

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing. While used in a number of different applications, the basic operation of x-ray tubes is similar. In general, x-rays, or x-ray radiation, are produced when electrons are produced, accelerated, and then impinged upon a material of a particular composition.

Typically, this process is carried out within an evacuated enclosure, or "can." Disposed within the can is an electron generator, or cathode, and a target anode, which is spaced apart from the cathode. In operation, electrical power is applied to a filament portion of the cathode, which causes electrons to be emitted. A high voltage potential is then placed between the anode and the cathode, which causes the emitted electrons accelerate towards a target surface positioned on the anode. Typically, the electrons are "focused" into a primary electron beam towards a desired "focal spot" located at the target surface. In addition, some x-ray tubes employ a deflector device to control the direction of the primary electron beam. For example, a deflector device can be a magnetic coil disposed around an aperture that is disposed between the cathode and the target anode. The magnetic coil is used to produce a magnetic field that alters the direction of the primary electron beam. The magnetic force can thus be used to manipulate the direction of the beam, and thereby adjust the position of the focal spot on the anode target surface. A deflection device can be used to control the size and/or shape of the focal spot.

During operation of an x-ray tube, the electrons in the primary electron beam strike the target anode surface (or focal track) at a high velocity. The target surface on the target anode is composed of a material having a high atomic number, and a portion of the kinetic energy of the striking electron stream is thus converted to electromagnetic waves of very high frequency, i.e., x-rays. The resulting x-rays emanate from the target surface, and are then collimated through a window formed in the x-ray tube for penetration into an object, such as a patient's body. As is well known, the x-rays can be used for therapeutic treatment, or for x-ray medical diagnostic examination or material analysis procedures.

As suggested above, the typical x-ray tube includes a filament portion, or emitter, that emits electrons by the process of thermionic emission. In particular, it is a characteristic of the emitter that, when heated, as by the passage of an electrical current therethrough, it emits a cloud of electrons. The emitted electrons, in turn, are focused into a beam of a desired diameter, directed at the target surface of the target anode. In the cathodes of known x-ray devices, the focusing process involves substantially enclosing the emitter with a structure defining an opening, or focusing slot, having a desired geometry, so as to allow only a portion of the emitted electrons through the focusing slot. In typical x-ray tubes, the electron emission and focusing functions are performed by an assembly comprising as many as eleven different parts.

For example, some known x-ray tubes typically employ, in addition to the emitter, means for isolating the emitter, as well as a structure for attaching the emitter to the cathode. In similar fashion, the emitted electrons are typically focused into a beam by an assembly that includes at least a focusing cup, focusing slots, and focusing tabs.

The large number of parts in the assemblies typically employed to perform the emission and focusing functions of the x-ray tube produces a variety of undesirable consequences. For example, the cost of such assemblies is necessarily higher than it would otherwise be in view of the large number of small parts that must be separately manufactured. It likewise follows that assembly costs for such devices are correspondingly higher, in view of the large number of parts comprising the assembly and the numerous operations required to assemble those parts.

Another problem with the use of assemblies employing multiple parts relates to the inevitable inaccuracies and errors that result during production of those parts. As is well known, various parameters of manufactured parts are allowed to vary within a permissible range. This range is typically referred to as the "tolerance" for that part. Electron emitting and focusing assemblies comprising multiple parts, each with its own range of tolerances, are problematic because while the parameters of a single part may be within an acceptable range, the cumulative effect of assembling a variety of parts, each of whose tolerances is allowed to vary, is that the integrity and/or performance of the x-ray device as a whole may be significantly compromised.

Furthermore, the use of multiple parts in assembling the emission and focusing structures of the typical x-ray tube greatly increases the opportunity for part combinations to fail either during manufacture or during operation of the x-ray device. That is, each connection between parts represents a potential failure point for the device.

Other significant problems in known x-ray tubes concern the characteristics of particular emitters, the geometry of the emitter, and the geometry of the components used to focus the emitted electrons, and the implications that those various geometries have for the overall performance of the x-ray device.

As discussed elsewhere herein, x-ray devices employ emitters that discharge electrons by a process generally known as thermionic emission. Each emitter has a characteristic often referred to as its "perveance." Specifically, the perveance of a particular emitter is related to the number of electrons discharged by an emitter and received at a target anode disposed a given distance away from the emitter. In general, a given target anode receives relatively more electrons from an emitter having a relatively higher perveance than from an emitter with a relatively lower perveance, i.e., the perveance value of a given emitter is proportional to the number of electrons discharged by that emitter and received at the target anode.

It is generally acknowledged that diagnostic image quality is at least partially a function of the number of electrons that impinge upon the target surface of the target anode, so that, in general, the more electrons that reach the target surface, the better the resulting image. The performance of a particular emitter can thus be evaluated in terms of the efficiency of that emitter, where the efficiency of the emitter is defined as the number of electrons impinging upon the target surface of the target anode, i.e., the perveance of the emitter, as a percentage of the total number of electrons discharged by the emitter. In general then, image quality improves as the efficiency of the emitter increases.

While the quality of the images generated by an x-ray device is to a large extent a function of emitter efficiency, it is also well understood that the quality of the diagnostic images additionally depends on the pattern, or focal spot, created by the emitted electrons on the target surface of the target anode. In general, smaller focal spots tend to produce better quality images than do larger, more diffuse focal spots.

In view of the foregoing principles, a variety of attempts have been made to improve emitter efficiency and to concentrate the electrons discharged from the emitter so that the electron beam thus formed is highly focused at the point where it impacts the target anode. As discussed in further detail below however, emitter efficiency and focal spot size are closely related, and success in improving one has typically been achieved only at the expense of the other.

In general, attempts to concentrate emitted electrons into a focused beam have placed emphasis on development of various geometries designed to enclose a portion of the emitter so that electrons that are free to leave the emitter do so in a defined pattern. The configuration typically employed in known x-ray tubes generally includes a long, slender emitter made of tungsten or similar material, substantially enclosed by a rectangular or box-shaped focusing assembly that defines a small opening, or focusing slot. While a rod-shaped emitter discharges uniform numbers of electrons radially in all directions, only those electrons that are able to pass through the focusing slot reach the target surface of the target anode. That is, the shapes of the emitter and focusing slot are not complementary, but rather are arranged so that the direction of travel, or velocity vectors, of the majority of the emitted electrons is generally not in the primary beam direction. Such arrangements, while producing a relatively focused beam of electrons, are nevertheless inefficient in that relatively few of the emitted electrons impinge upon the target surface of the target anode. As previously noted, diagnostic image quality is compromised by inefficient emitters.

Accordingly, the focusing slot must be sufficiently large to pass enough electrons to achieve a desirable emitter efficiency. As discussed below however, increasing the size of the focusing slot introduces at least one significant problem.

As noted earlier, the emitters typically employed in know x-ray devices tend to discharge a large number of electrons whose velocity vectors are not in the desired direction of the electron beam. Rather, many of these electrons travel only in the general direction of the target surface of the target anode, along paths that are divergent from the primary beam direction. As a result, the pattern defined on the target surface of the target anode, i.e., the focal spot, is larger than it would be if the majority of the electrons traveled in the primary beam direction. Thus, while relatively larger focusing slots facilitate some improvement in emitter efficiency, they also result in larger focal spots which compromise the quality of the diagnostic images produced by the x-ray device.

Those skilled in the art are aware of the tension between focal spot size and emitter efficiency. As a result, at least one attempt has been made to resolve the problem. However, as discussed below, this attempted resolution fails to adequately address the problems enumerated herein.

In particular, a focusing element has been developed that does not substantially enclose the emitter, but rather assumes the shape of the high voltage field contours present in the x-ray device in an attempt to direct emitted electrons in a narrow beam towards the target surface of the target anode. While such a focusing element arguably improves emission efficiency by allowing more electrons to reach the target surface of the target anode, the focal spot produced by the emitted electrons becomes larger and consequently more diffuse, thereby compromising the quality of the images produced by the device.

Additionally, because the emitter and the focusing element have different electrical continuities, an irregularity is typically formed in the high voltage field contours. As a result of the irregularity in the high voltage field contours, a significant portion of the electrons discharged by the emitter diverge from the primary beam direction. Consequently, the overall diameter of the electron beam produced by this arrangement is relatively larger than would otherwise be the case, and thereby results in a correspondingly larger focal spot on the target anode. Such a result further exacerbates the focal spot problems imposed by the geometry of this focusing element. Finally, the complex shape of such focusing elements makes them difficult to machine, and therefore, very expensive.

Not only are known emitter and focusing element geometries inherently limited in terms of their ability to produce optimum focal spots, but the inadequacies of those geometries are further aggravated by changes that can occur in the spacing between the anode and the cathode. In particular, because those geometries tend to produce a relatively more diffuse electron beam, any change in the spacing between the anode and the cathode tends to exacerbate that effect and thereby causes the beam to become more diffuse. As discussed elsewhere herein, such diffuse beams produce large focal spots that are not conducive to high quality images. Because the distance between the anode and the cathode may vary during operation of the x-ray device, the sensitivity of known emitter and focusing element geometries to such variations is a significant limitation.

Finally, at least one other limitation imposed by known emitter and focusing element geometries concerns changes in the beam current of the device. In general, "beam current" refers to the amount of current flow, or the number of electrons, traveling from the emitter to the anode. Changes in the beam current, such as may be required for various different types of exposures, tend to increase or decrease the size of the focal spot produced by the beam. For example, a relative increase in beam current increases the size of the focal spot produced by the beam. The phenomenon is particularly problematic where, as in the case of typical x-ray devices, the emitter and focusing element arrangement is such that many of the electrons in the electron beam travel along paths divergent from the primary beam direction and thus tend to contribute to relatively larger focal spots.

As discussed elsewhere herein, a large focal spot is undesirable. However, while a reduction in beam current would produce a smaller focal spot, a relatively lower level of beam current may not be appropriate or adequate in some applications. Thus, in known x-ray devices, the size of the focal spot is highly sensitive to changes in beam current. Such changes in beam current are commonly known as "blooming." Blooming is undesirable because it tends to compromise the quality of the images produced by the device and/or it compromises the flexibility of the device.

In addition to the shortcomings of known focusing element and emitter geometries, the cathode support structures typically employed in x-ray devices are problematic as well. In particular, known cathode support structures are problematic at least because they employ a large number of separate parts that must be separately manufactured and assembled. The use of a large number of parts necessarily implicates relatively higher assembly and production costs than would otherwise be the case. For example, a typical cathode support structure includes such components as filament lead ceramics, a cathode cup, a filament lead cathode cup mounting arrangement, and the filament-to-cup attachment mechanism. As suggested elsewhere, such a multiplicity of parts, in addition to imposing relatively higher manufacturing costs, also introduces numerous potential failure points in the x-ray device.

In view of the foregoing problems and shortcomings with the existing x-ray tube cathodes, it would be an advancement in the art to provide a cathode, and associated cathode support structure, that is simple and relatively inexpensive to manufacture. Also, the cathode should be highly efficient in terms of electron emission and should produce a focal spot that is substantially insensitive to changes in operating conditions such as anode-to-cathode spacing, or variations in beam current.

SUMMARY AND OBJECTS OF THE INVENTION

The present invention has been developed in response to the current state of the art, and in particular, in response to these and other problems and needs that have not been fully or adequately solved by currently available x-ray tube cathodes. Thus, it is an overall object of embodiments of the present invention to provide a cathode that integrates the emission and focusing functions into a single, readily manufacturable element that substantially improves the performance of the x-ray device. Embodiments of the present invention are particularly suitable for use in those applications requiring an efficient cathode capable of producing an electron beam having a relatively small focal spot.

In a preferred embodiment, the integral cathode includes an emitter comprising a refractory metal, such as tungsten, or the like. A bend, preferably parabolic, is imposed in the emitter so that when viewed in cross-section, the emitter describes a parabolic arc whose concave side is oriented towards the target surface of a target anode. The bend in the emitter is preferably maintained by way of a support cartridge in which the emitter is received. Preferably, the support cartridge comprises an electrically non-conductive material such as ceramic. In a preferred embodiment, a plurality of alternating slots are cut from the emitter so that the emitter defines a shape generally in the form of multiple "S"s joined end-to-end.

In operation, power is applied to one end of the emitter so that an electrical current passes travels along the multiple "S" path defined in the emitter by the slots. The flow of current through the emitter causes the emitter to discharge electrons by thermionic emission. The amount of electrons discharged from the emitter is at least partially a function of the length of the electrical path defined by the emitter and the power applied to the emitter.

By virtue of the emitter's shape, electrons discharged along all portions of the concave surface of the parabolic arc described by the emitter are naturally directed inwardly along convergent paths leading to the target surface of the target anode. Thus, the shape of the emitter has the effect of concentrating the discharged electrons into an electron beam directed at the target surface. Because the surface of the emitter from which electrons are discharged is oriented in the primary beam direction, relatively few of the discharged electrons stray from the primary beam direction, and the diameter of the beam thus generated is correspondingly small. Consequently, the electron beam produces a relatively small focal spot which is relatively insensitive to changes in spacing between the anode and cathode and/or changes in beam current. Finally, the tendency of discharged electrons to travel primarily in the primary beam direction permits the focusing slot defined by the support cartridge to be relatively large, thereby enhancing the efficiency of the emitter by permitting relatively more discharged electrons to pass to the target surface of the target anode.

These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above recited and other advantages and objects of the invention are obtained, a more particular description of the invention will be rendered by reference to specific embodiments thereof which are illustrated in the appended drawings. It will be appreciated that the drawings are not necessarily drawn to scale, and that they are intended to depict only the presently preferred and best mode embodiments of the invention, and are not to be considered to be limiting of the scope of the invention.

DETAILED DESCRIPTION OF THE PREFERRED EMBODIMENTS

Reference will now be made to figures wherein like structures will be provided with like reference designations. It is to be understood that the drawings are diagrammatic and schematic representations of various embodiments of the invention, and are not to be construed as limiting the present invention, nor are the drawings necessarily drawn to scale.

Figure 1:
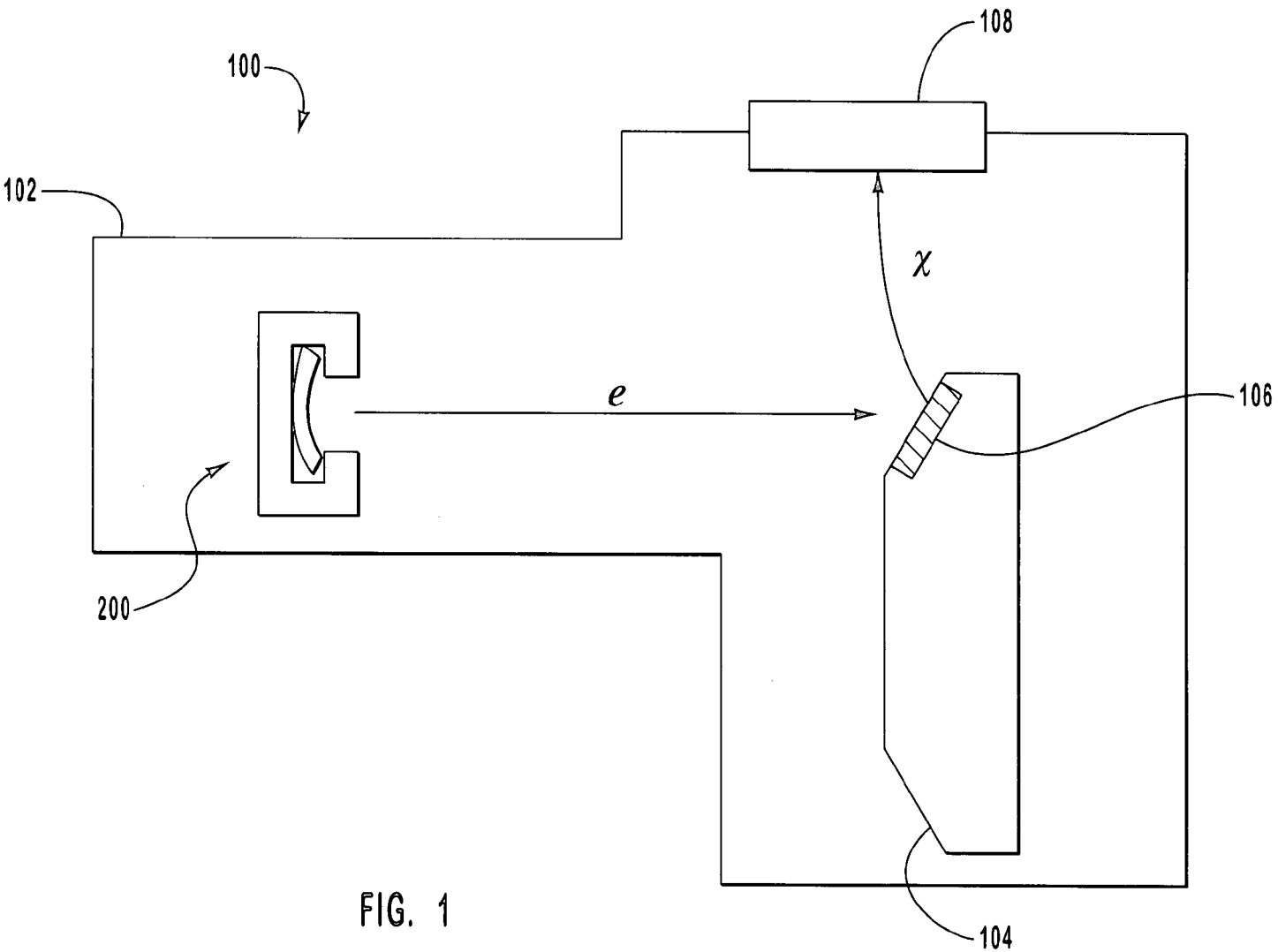
FIG. 1 illustrates an embodiment of an integral cathode and its relation to other components of the x-ray tube.

In general, the present invention relates to an integral cathode for use in x-ray tubes. FIGS. 1 through 3 indicate various embodiments of an integral cathode conforming to the teachings of the invention.

Reference is first made to FIG. 1, which depicts an x-ray tube indicated generally as 100. X-ray tube 100 includes a vacuum enclosure 102, and disposed inside vacuum enclosure 102 are a target anode 104, and an integral cathode, indicated generally at 200. In operation, electrical power is applied to integral cathode 200, which causes a beam of electrons, indicated at e, to be emitted by thermionic emission. A potential difference is applied between integral cathode 200 and target anode 104, which causes electrons e emitted by integral cathode 200 to accelerate and impinge upon a focal spot location 106 on the target anode 104. A portion of the resulting kinetic energy is released as x-rays, indicated at x, which are then emitted through window 108 and into, for example, the body of a patient.

Figure 2A:
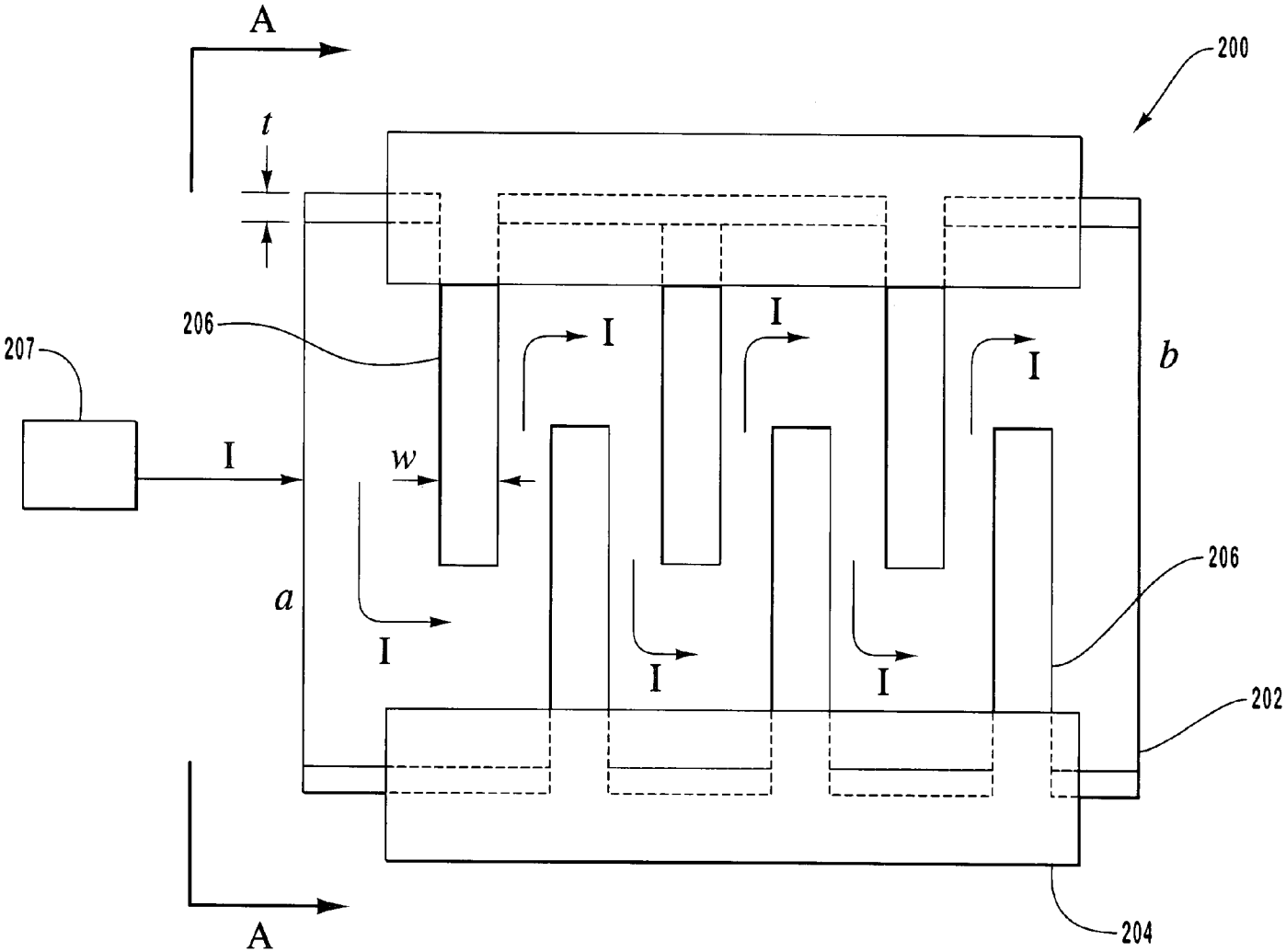
FIG. 2A is a top view looking downwards to the emitting surface of an embodiment of an integral cathode.
Figure 3:
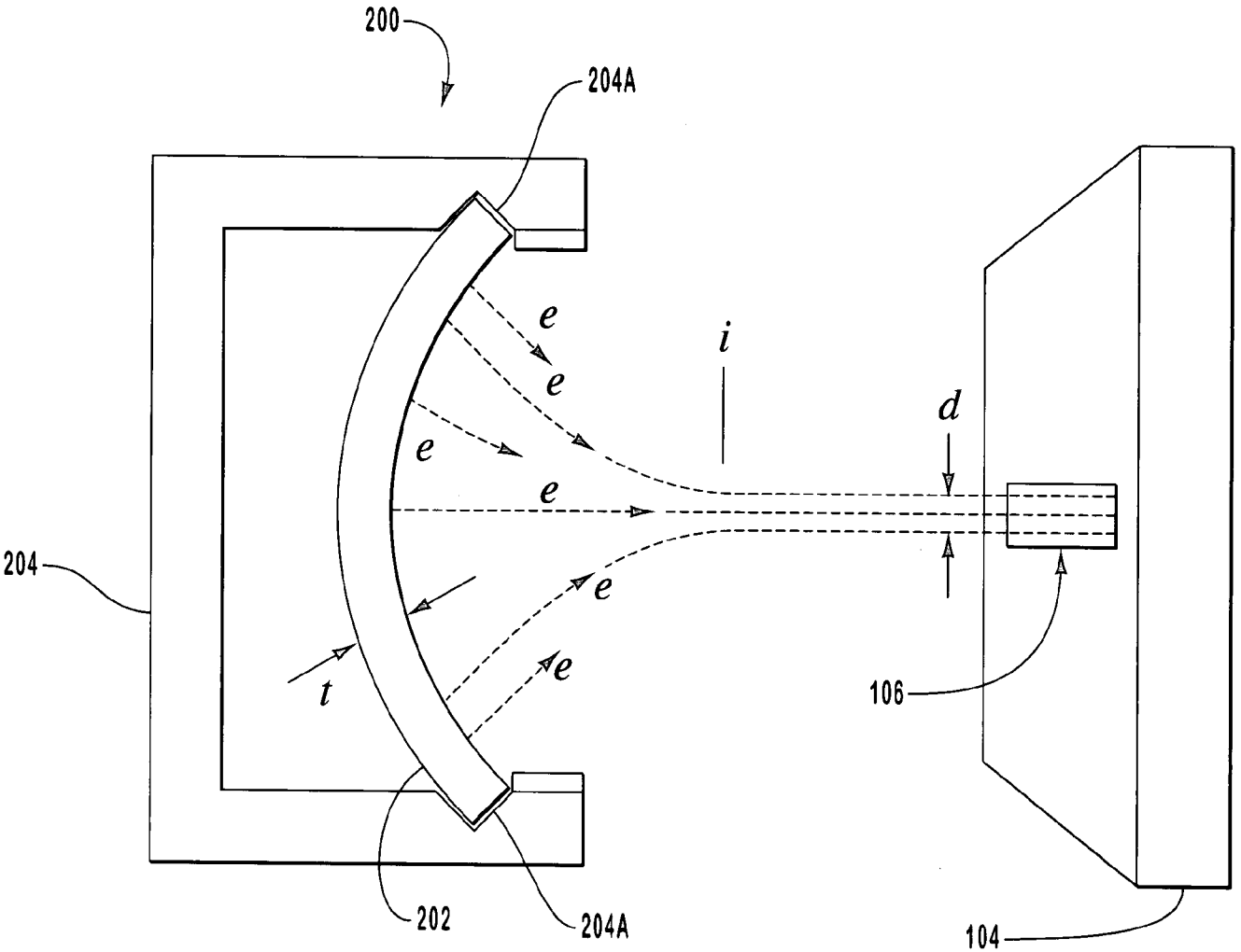
FIG. 3 is a cross-section view taken along line AA of FIG. 2A, indicating the disposition of an embodiment of the integral cathode, and further indicating the operational relationship of the integral cathode with respect to the target surface of a target anode.

With reference now to FIG. 2A, further details regarding the construction of integral cathode 200 are provided. In general, integral cathode 200 includes an emitter 202 mounted in a support cartridge 204. Preferably, a plurality of slots 206 are defined in emitter 202. As suggested in FIG. 2A, slots 206 cooperate with each other to define a continuous S-shaped electrical current path. In operation, an electrical current I is caused to flow from electrical power source 207 to end a of emitter 202, and thence to end b of emitter 202 along the electrical current path defined by slots 206. As a result of the electrical current thus applied, electrons are discharged from emitter 202 by the process of thermionic emission.

In a preferred embodiment, the emissive material employed for use as emitter 202 preferably comprises a refractory metal such as tungsten. In general, a refractory metal with a melting point of about 2,400° to 2,500° Centigrade or above is preferred. However, it will be appreciated that a wide variety of metals and/or combinations thereof may profitably be employed in this application. Accordingly, any materials or combinations thereof providing the functionality disclosed herein, are contemplated as being within the scope of the present invention. As the malleability of emitter element 202 is also an important consideration in the construction and assembly of integral cathode 200, emitter 202 is preferably doped with rhenium or the like.

Preferably, support cartridge 204 is composed of an electrically non-conductive material that will, with the exceptions disclosed herein, electrically isolate emitter 202 from the structure and/or other components of the x-ray device. Such materials contemplated by the present invention include, but are not limited to, ceramics and the like. Note however, that electrically conductive materials including, but not limited to, iron or the like, may also be employed, provided that the electrical conductivity of the material employed is sufficiently neutralized so as to foreclose material impairment of the operation of emitter 202, as disclosed herein. The electrical conductivity of such materials may be neutralized in a number of ways including, but not limited to, cataphoretically coating the emitter material or a portion thereof with one or more electrically non-conductive materials, or combinations thereof. Generally, any material providing the functionality, as disclosed herein, of support cartridge 204 is contemplated as being within the scope of the present invention.

With continuing reference now to FIG. 2A, it will be appreciated that the geometry of emitter 202 may be varied in any number of ways so as to facilitate achievement of a desired emissive effect. In particular, it will be appreciated that by varying one or more parameters pertaining to the length of the electrical current path defined by slots 206 in emitter 202, such parameters including, but not limited to, the number, shape, size, and arrangement of slots 206, a desired emissive effect may thereby be achieved. It will likewise be appreciated that the thickness t of emitter 202 may be varied to the same end. Note that slots 206 represent but one type of cut out portion adapted to define the aforesaid electrical current path. For example, slots 206 could be replaced with a plurality of overlapping holes. It will thus be appreciated that various shapes, sizes, numbers and arrangements of cutout portions may be combined in any of a number of ways so as to define a particular electrical current path and thereby facilitate achievement of a desired emissive effect.

It will further be appreciated that the emissive effects achieved with emitter 202 may be desirably varied in a number of other ways as well. As one example, the amount of electrical current I applied to emitter 202 has a correlative effect on the number of electrons emitted therefrom. Thus, the electrical current I may be varied to the extent necessary to achieve a desired emissive effect from emitter 202.

Finally, as discussed above and elsewhere herein, there are a wide variety of variables, parameters and the like that may be adjusted or varied so as to achieve a desired emissive effect. It will be appreciated that these variables and parameters may be adjusted or varied either alone and/or in various combinations with each other so as to achieve one or more desired emissive effects.

Figure 2C:
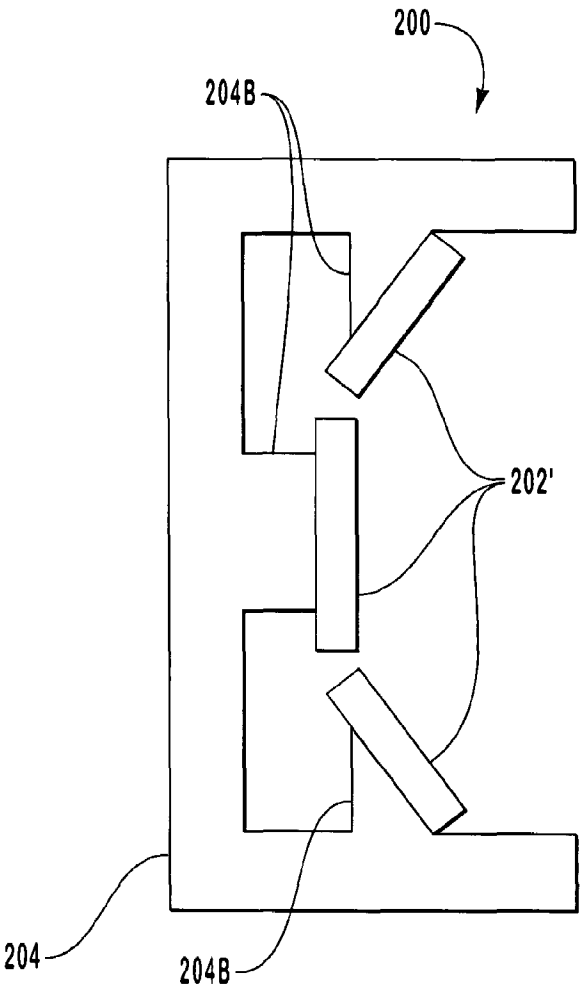
FIG. 2C is a cross-section view, generally oriented along line AA of FIG. 2A, of an alternative embodiment of the integral cathode.
Figure 2B:
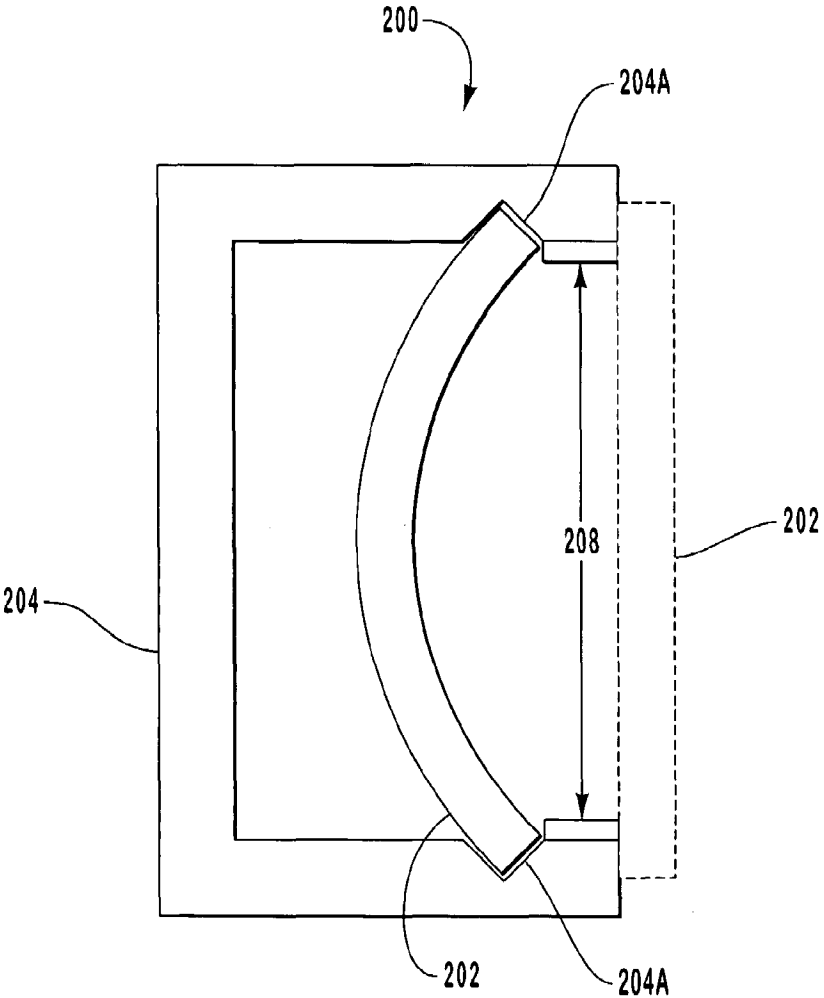
FIG. 2B is a cross-section view taken along line AA of FIG. 2A, and indicating various structural details of an embodiment of the integral cathode.

With reference now to FIG. 2B, and with continuing reference to FIG. 2A, additional details regarding the elements and construction of integral cathode 200 are indicated. As indicated in FIG. 2B, a preferred embodiment of integral cathode 200 comprises only two parts. As a result, the problems associated with tolerance stacking, discussed in detail elsewhere herein, are substantially eliminated by integral cathode 200. In this regard, at least, integral cathode 200 represents a significant improvement over known cathodes which typically employ a multiplicity of parts.

Directing attention now to the specific elements of integral cathode 200, support cartridge 204 includes two opposing retaining arms 204A which cooperate with each other to define a slot 208, as indicated in FIG. 2B. Generally however, any structure or structures providing the functionality of support cartridge 204 and/or its constituent elements, as disclosed herein, is contemplated as being within the scope of the present invention.

The minimal number of parts employed in the construction of integral cathode 200 greatly simplifies the assembly process. In particular, integral cathode 200 is preferably assembled by disposing emitter 202 in the position indicated by the dashed lines in FIG. 2B and then exerting a downward force on emitter 202 until the edges of emitter 202 become lodged in retaining arms 204A. Thus, the downward force cooperates with retaining arms 204A to deform emitter 202 into a desired configuration. The retaining arms 204A cooperate with each other to maintain emitter 202 in that desired configuration. In a preferred embodiment, the emitter is deformed by support cartridge 204 so that a bend is defined in the emitter. Preferably, the width of emitter 202 is greater than the width of the cavity defined by support cartridge 204 so as to facilitate achievement of the desired emitter configuration. Support cartridge 204 thus serves at least the purposes of providing structural support for emitter 202, defining a desired configuration for emitter 202, and maintaining emitter 202 in the defined configuration.

In an alternative embodiment, support cartridge 204 does not define the configuration of emitter 202, but rather serves solely as a foundation or base therefore, that is, to provide structural support for emitter 202. This alternative embodiment of support cartridge 204 is particularly well-adapted for emitters whose shape has been defined prior to the emitter being joined to support cartridge 204. One example would be a bowl-shaped emitter, wherein the emitter is formed into a bowl shape during construction and is subsequently attached to support cartridge 204.

With continuing attention now to FIG. 2B, the bend imposed in emitter 202 by support cartridge 204 preferably describes a portion of a parabola, i.e., a parabolic arc, when viewed in cross-section. It will be appreciated however, that a variety of other geometries may be employed to provide the functionality of emitter 202, as disclosed herein. Other emitter geometries contemplated as being within the scope of the present invention include, but are not limited to, a bend that describes an arc of a circle, angular bends such as one substantially in the shape of a "V", or any geometry that includes two or more non-parallel emitting surfaces directed at least partially towards the target anode so that electrons discharged from the emitting surfaces will converge at a focal spot to form an electron beam. Such surfaces may be disposed in various configurations, including, but not limited to, configurations wherein the emitting surfaces are adjacent to each other, or opposite each other.

It will likewise be appreciated that emitters that describe segments of three dimensional shapes, spheres for example, would likewise provide the functionality disclosed herein, such emitters are accordingly contemplated as being within the scope of the present invention. One example of such a segment would be a bowl-shaped emitter, wherein the concave surface of the emitter is directed towards the target anode.

After emitter 202 has been positioned in support cartridge 204, slots 206 (see FIG. 2A) are cut in emitter 202. In a preferred embodiment, at least the insertion of emitter 202 into support cartridge 204 is accomplished in an automated fashion, such as by a robot or the like. Likewise, slots 206 are preferably cut by a robotically controlled laser or the like. In an alternative embodiment, all of the assembly steps are at least partially performed by a robot.

Preferably, electrical connections required to facilitate the flow of current I through emitter 202 are attached to emitter 202 by a laser welding operation. It will be appreciated, however, that a variety of other attachment methods could be used. Such other attachment methods include, but are not limited to, tungsten inert gas welding or the like, and are accordingly contemplated as being within the scope of the present invention. It will likewise be appreciated, that the assembly of integral cathode 200 can be effectuated by a variety of other assembly methods. Accordingly, those other methods are contemplated as being within the scope of the present invention. Such other methods include, but are not limited to, cutting slots 206 in emitter 202 prior to pressing emitter 202 into support cartridge 204.

With reference now to FIG. 2C, while one embodiment of emitter 202 comprises a single piece of material, emitter 202 may alternatively comprise a plurality of electron sources, or subsidiary emitting portions 202', collectively arranged in a configuration that would provide the functionality of emitter 202, as disclosed herein. Such an arrangement would obviate the need for retaining arms 204A and may actually improve the efficiency of emitter 202 by eliminating any electron blocking effect imposed by retaining arms 204A.

Further, subsidiary emitting portions 202' may all consist of the same material, or alternatively, different subsidiary emitting portions 202' may be composed of different materials. As one example of this alternative embodiment, an emitter could be constructed of three subsidiary emitting portions 202' wherein a central subsidiary emitting portion 202' is composed of one material, and subsidiary emitting portions 202' disposed on either side of the central subsidiary emitting portion 202' are composed of another material. It will be appreciated that the number and composition of the subsidiary emitting portions 202' may be varied as required to achieve a desired emissive effect. It will likewise be appreciated that while the geometry of subsidiary emitting portions 202' is indicated in FIG. 2C as being generally planar, subsidiary emitting portions 202' may also be formed so as to describe curves or bends, as discussed elsewhere herein.

In this alternative embodiment, each of the subsidiary emitting portions may be supplied by its own dedicated source of electrical power, or alternatively, the emitting portions may all be supplied by a single source of power. As suggested elsewhere herein, the power supplied to one or more of the emitting portions may be varied as required to achieve one or more desired emissive effects.

Directing attention now to FIG. 3, additional details regarding the operation of integral cathode 200 are indicated. In particular, application of an electrical current I to emitter 202 causes electrons e to be discharged from emitter 202, by way of the thermionic emission process described elsewhere herein. As suggested in FIG. 3, it is a natural consequence of the parabolic shape of emitter 202 that a substantial number of the electrons e discharged from emitter 202 are directed along velocity vectors that converge with each other. It is thus a valuable feature of the present invention that emitter 202 serves to focus the discharged electrons e without the use of structures such as are employed in known cathodes. The converging electrons e form a focal spot and an electron beam having a diameter d. Preferably, focal spot i is formed at focal spot location 106 of target anode 104. Finally, the impact of electrons e on focal spot location 106 causes the emission of x-rays, which in the illustration would be oriented in a direction generally leaving the page towards the reader. For at least the reasons discussed below, the convergence of discharged electrons e achieved by the geometry of emitter 202 represents a significant improvement over known cathodes wherein electrons are discharged along substantially divergent paths.

Because the majority of electrons discharged from emitter 202 are discharged in the primary beam direction, and not along divergent paths as is typically the case with known cathodes, relatively little is required in the way of structure to control or direct the emitted electrons. Accordingly, the dimensions of slot 208 (see FIG. 2B) through which the discharged electrons e pass, can be made relatively greater than would otherwise be possible, with the important consequence that relatively more of the electrons discharged from emitter 202 reach focal spot location 106 of target anode 104. Thus, it is a valuable feature of the geometry of emitter 202 that it facilitates a significant improvement in both the perveance and the efficiency of integral cathode 200. Furthermore, because the emission and focusing operations of integral cathode 200 are performed by the same part, the construction and assembly of integral cathode 200 is greatly simplified.

With continuing reference to FIG. 3, another valuable feature of integral cathode 200 relates to the diameter of the electron beam produced thereby. In particular, because emitter 202 naturally tends to discharge electrons in the primary beam direction, the diameter d of the electron beam thus produced is relatively smaller than that produced by known devices where discharged electrons travel along divergent paths and thus tend to produce relatively large diameter electron beams. As a consequence of its relatively small diameter, an electron beam produced by integral cathode 200 produces a relatively small focal spot on focal spot location 106 of target anode 104, and thereby facilitates a significant improvement in the quality of diagnostic images produced by the x-ray device.

Furthermore, because the size of the focal spot produced by integral cathode 200 is relatively smaller than that produced by known cathodes, that focal spot is substantially less sensitive to changes in anode to cathode spacing. Specifically, known cathodes tend to produce relatively large diameter electron beams. And as noted earlier, the distance between the cathode and the target anode may vary during operation of the x-ray device so that as the distance between the emitter and target increases, for example, the diameter of the electron beam becomes unacceptably large. However, because the beam produced by the present invention is relatively small in diameter, changes in anode to cathode spacing have no material impact on the electron beam diameter or focal spot size. Similarly, the focal spot produced by the present invention is not materially impaired by changes in beam current.

Finally, note that the electron beam produced by emitter 202 can be manipulated by an alternative embodiment of support cartridge 204. In particular, a portion of support cartridge 204 is partially metallized, or otherwise rendered electrically conductive, so that application of a voltage to the metallized portion allows support cartridge 204 to be used to move the electron beam, shape the focal spot, change the size of the focal spot, change the position of the focal spot, and/or otherwise manipulate the electron beam and focal spot. In a preferred embodiment, retaining arms 204A would be metallized and have a voltage applied thereto so as to provide one or more of the aforementioned functionalities. It will be appreciated that the applied voltage may be varied as necessary to achieve a desired effect on the electron beam and/or the focal spot.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In an x-ray tube comprising a vacuum enclosure having disposed therein a target anode with a target surface, an integral cathode disposed in the vacuum enclosure and being spaced apart from the target surface of the target anode, the integral cathode comprising:

(a) an emitter configured to receive a flow of electrical current such that thermionic emission of electrons from the emitter is facilitated, said emitter having a predetermined geometrical configuration oriented to cause at least some emitted electrons to be directed at the target surface of the target anode and converge at a focal spot, wherein said predetermined geometrical configuration provides an emitter having a cross-section substantially in the shape of an arc so that a concave side of said emitter is directed towards the target surface of the anode, and the emitter including at least one cutout; and (b) a support cartridge, said support cartridge providing structural support for said emitter.

2. The integral cathode as recited in claim 1, wherein the emitter is substantially confined within the support cartridge.

3. The integral cathode as recited in claim 1, wherein the arc shape of the emitter comprises one of: a substantially parabolic arc; and, a substantially circular arc.

4. The integral cathode as recited in claim 1, wherein the emitter substantially comprises a single piece of material.

5. The integral cathode as recited in claim 1, wherein the emitter substantially comprises a refractory metal.

6. The integral cathode as recited in claim 1, wherein the emitter is doped with a dopant.

7. The integral cathode as recited in claim 1, wherein the emitter comprises a plurality of subsidiary emitting portions.

8. The integral cathode as recited in claim 1, wherein the support cartridge serves to substantially maintain the emitter in the arc shape.

9. The integral cathode as recited in claim 1, wherein the support cartridge substantially comprises one of: a ceramic material; and, cataphoretically coated iron.

10. The integral cathode as recited in claim 1, wherein the support cartridge comprises:

an electrically conductive portion; and a non-electrically conductive portion.

11. An integral cathode, comprising:

an emitter substantially comprising an emissive surface having a shape configured to direct a majority of electrons emitted from spatially diverse locations on the emissive surface to a common focal point, the emitter being configured to receive a flow of electrical current such that thermionic emission of electrons from the emitter is facilitated, wherein the emitter includes at least one cutout; and a support cartridge within which the emitter is at least partially received.

12. The integral cathode as recited in claim 11, wherein the emissive surface substantially comprises a single piece of material.

13. The integral cathode as recited in claim 11, wherein the emitter is substantially confined within the support cartridge.

14. The integral cathode as recited in claim 11, wherein the emissive surface is substantially concave in shape.

15. The integral cathode as recited in claim 14, wherein the substantially concave shape comprises one of: a substantially parabolic arc; and, a substantially circular arc.

16. The integral cathode as recited in claim 11, wherein the emitter substantially comprises a refractory metal.

17. The integral cathode as recited in claim 11, wherein the emitter is doped with a dopant.

18. The integral cathode as recited in claim 11, wherein the support cartridge serves to substantially maintain the emitter in the shape.

19. The integral cathode as recited in claim 11, wherein the support cartridge substantially comprises one of: a ceramic material; and, cataphoretically coated iron.

20. The integral cathode as recited in claim 11, wherein the support cartridge comprises at least one of:

an electrically conductive portion; and a non-electrically conductive portion.

21. An integral cathode, comprising:

an emitter substantially comprising a substantially concave emissive surface configured to be oriented toward a target surface of a target anode, and the emitter including at least one cutout; and a support cartridge within which the emitter is at least partially received.

22. The integral cathode as recited in claim 21, wherein the substantially concave shape comprises one of: a substantially parabolic arc; and, a substantially circular arc.

23. The integral cathode as recited in claim 21, wherein the emissive surface substantially comprises a single piece of material.

24. The integral cathode as recited in claim 21, wherein the emitter substantially comprises a refractory metal.

25. The integral cathode as recited in claim 21, wherein the support cartridge comprises:

an electrically conductive portion; and a non-electrically conductive portion.

26. An x-ray device, comprising:

a vacuum enclosure;

a target anode having a target surface and being substantially disposed within the vacuum enclosure such that the target anode and target surface are spaced apart from the vacuum enclosure; and an integral cathode substantially disposed within the vacuum enclosure and comprising:

an emitter substantially comprising an emissive surface having a shape configured to direct a majority of electrons emitted from spatially diverse locations on the emissive surface to a common focal point proximate the target surface, wherein the emitter includes at least one cutout; and a support cartridge within which the emitter is at least partially received.

27. The x-ray device as recited in claim 26, wherein the emitter is configured to receive a flow of electrical current such that thermionic emission of electrons from the emitter is facilitated.

28. The x-ray device as recited in claim 26, wherein the emissive surface of the emitter substantially comprises a single piece of material.

29. The x-ray device as recited in claim 26, wherein the emissive surface is substantially concave in shape.

30. The x-ray device as recited in claim 29, wherein the substantially concave shape comprises one of: a substantially parabolic arc; and, a substantially circular arc.

31. The x-ray device as recited in claim 26, wherein the emitter substantially comprises a refractory metal.

32. The x-ray device as recited in claim 26, wherein the emitter is doped with a dopant.

33. The x-ray device as recited in claim 26, wherein the support cartridge substantially comprises one of: a ceramic material; and, cataphoretically coated iron.

34. The x-ray device as recited in claim 26, wherein the support cartridge comprises at least one of:

an electrically conductive portion; and a non-electrically conductive portion.

35. The x-ray device as recited in claim 26, wherein the support cartridge facilitates maintenance of the emitter in a predetermined shape.

* * * * *

UNITED STATES PATENT AND TRADEMARK OFFICE

CERTIFICATE OF CORRECTION

PATENT NO. : 7,062,017 B1
APPLICATION NO. : 09/639684
DATED : June 13, 2006
INVENTOR(S) : Runnoe It is certified that error appears in the above-identified patent and that said Letters Patent is hereby corrected as shown below:

Column 3
Line 44, change "below" to --below,--
Line 46, change "know" to --known--

Column 5
Line 51, after "current", remove [passes]

Signed and Sealed this

Thirteenth Day of July, 2010

David J. Kappos

David J. Kappos
*Director of the United States Patent and Trademark Office*